United States Patent [19]

Seuster

[11] Patent Number: 4,690,194

[45] Date of Patent: Sep. 1, 1987

[54] DOOR WHICH CAN BE ROLLED UP

[76] Inventor: Kurt Seuster, Mühlenbach 9, 5990 Altena, Fed. Rep. of Germany

[21] Appl. No.: 4,312

[22] Filed: Jan. 8, 1987

Related U.S. Application Data

[63] Continuation of Ser. No. 679,457, Dec. 7, 1984, abandoned.

[30] Foreign Application Priority Data

Dec. 13, 1983 [DE] Fed. Rep. of Germany ..... 3345016

[51] Int. Cl.[4] ..... A47G 5/02

[52] U.S. Cl. ..... 160/265; 160/271; 160/133

[58] Field of Search ..... 160/265, 315, 321, 323 R, 160/133, 271

[56] References Cited

U.S. PATENT DOCUMENTS 1,828,623 10/1931 Sacerdote ..... 160/265 X
3,180,401 4/1965 Gambon et al. ..... 160/265
3,460,602 8/1969 Hugus ..... 160/265
3,878,879 4/1975 Manns ..... 160/273 R

FOREIGN PATENT DOCUMENTS 8206622 8/1982 Fed. Rep. of Germany .

*Primary Examiner*—Ramon S. Britts
*Assistant Examiner*—David M. Purol
*Attorney, Agent, or Firm*—Becker & Becker, Inc.

[57] ABSTRACT

A sliding door, which includes a winding tube, which is mounted on a winding shaft for winding up and unwinding a hanging door for opening and closing-off an opening, and a take-up and tensioning mechanism which is disposed between the free end of the hanging door and the winding shaft and which has traction members which are guided about guide pulleys. The take-up and tensioning mechanism for the hanging door includes take-up or tensioning pulleys, which are freely rotatably mounted on the winding shaft on both sides of the winding tube, and pretensioned leg springs which are disposed between the pulleys and the winding shaft.

3 Claims, 3 Drawing Figures

8
7
3
II
4
15
8
16
6
10
13
14
10
9
2
2
9
5
5
17
III
III
11
12
1
11
II
17
17
11
11
2
5
2
1
11

DOOR WHICH CAN BE ROLLED UP

This application is a continuation of application Ser. No. 679,457, filed Dec. 7, 1984, now abandoned.

BACKGROUND OF THE INVENTION

1. Field of the Invention

The present invention relates to a door which can be rolled up, also known as a sliding door, and includes a winding tube, which is mounted on a winding shaft for winding up and unwinding a hanging door for opening and closing an opening, and a take-up and tensioning mechanism, which is disposed between the free end of the hanging door and the winding shaft and which has traction members which are guided about guide pulleys.

2. Description of the Prior Art

German Gebrauchsmuster No. 82 06 622 discloses a sliding door of the aforementioned general type, according to which the take-up and tensioning mechanism for the hanging door comprises conical rope or cable pulleys, which are mounted on the winding shaft on both sides of the winding tube, and block and tackle traction members which are pretensioned by a tension spring. The tension springs are disposed on both sides of the opening between guide pulleys of the block and tackle, and the base. Such take-up and tensioning mechanisms for the hanging door of a sliding door result in considerable structural expense, and for safety reasons must be enclosed in a casing.

An object of the present invention is to provide a sliding door having for the hanging door a take-up and tensioning mechanism which has a simple construction, has a long service life, and presents no risk to safety.

BRIEF DESCRIPTION OF THE DRAWING

This object, and other objects and advantages of the present invention, will appear more clearly from the following specification in conjunction with a preferred embodiment illustrated in the drawing, in which.

SUMMARY OF THE INVENTION

Figures 1, 2, 3:
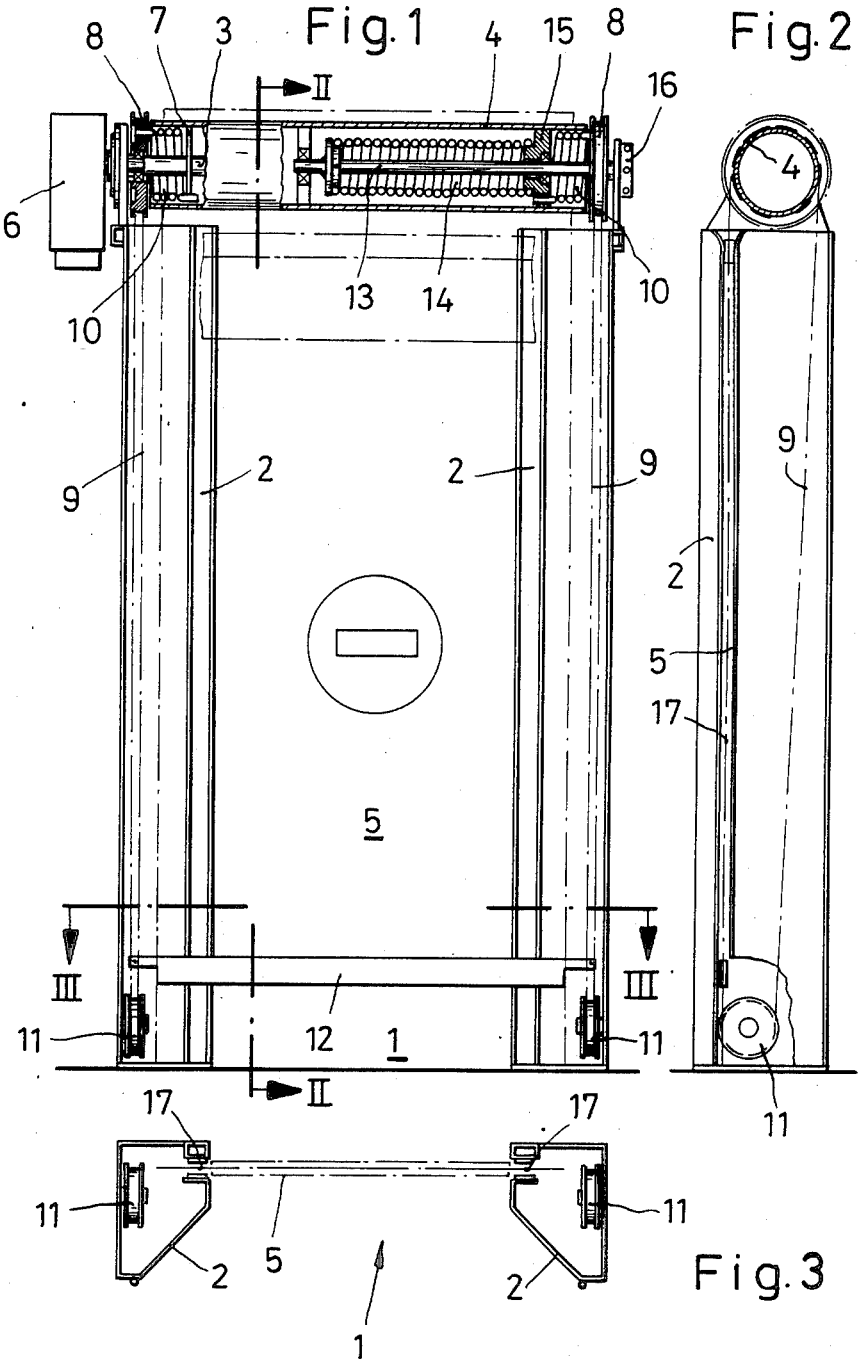
FIG. 1 is a schematic view of one inventive embodiment of a sliding door showing a partially sectioned winding tube.
FIG. 2 is a cross-sectional view of the sliding door of FIG. 1 taken along the line II—II thereof.
FIG. 3 is a cross-sectional view of the sliding door of FIG. 1 taken along the line III—III thereof.

The sliding door of the present invention is characterized primarily in that the take-up and tensioning mechanism comprises take-up or tensioning pulleys, which are freely rotatably mounted on the winding shaft on both sides of the winding tube, and prestressed leg springs which are disposed between the pulleys and the winding shaft.

Pursuant to one practical embodiment of the present invention, the leg springs can be recessed in the open ends of the winding tube, which encases these springs.

It is furthermore proposed for the traction members of the take-up and tensioning mechanism to utilize belts which have a flat cross section, and which have a thickness which corresponds approximately to the thickness of the hanging door. This minimizes the difference in length which exists between the hanging door and the traction members, and which must be compensated for by the leg springs.

In a sliding door constructed pursuant to the present invention, the take-up and tensioning mechanism for the hanging door is prestressed by two leg springs, which are encased in a structural part which already exists, namely the winding tube. As a result, no additional casing is required. Furthermore, the two prestressed leg springs, which are disposed between the winding shaft and the take-up or tensioning pulleys for the belts, are only subjected to bending stresses, and therefore have a particularly long service life, which is still further enhanced by minimizing the travel difference between the belts and the hanging door.

DESCRIPTION OF PREFERRED EMBODIMENTS

Referring now to the drawing in detail, a winding shaft 3, which has a winding tube 4 concentrically mounted thereon is disposed above a framework 2 which laterally delimits an opening 1. example, a transparent hanging door 5 for closing off the opening 1 can be wound up and unwound with the winding tube 4.

Next to the drive unit 6, the winding tube 4 is mounted directly onto the winding shaft 3 by means of an inwardly disposed spring-receiving means 7. In front of the open end of the winding tube 4, a take-up or tensioning pulley 8 for a belt 9 is freely rotatably mounted on the winding shaft 3. In the space between the spring-receiving means 7 and the pulley 8, there is accommodated a leg spring 10, the leg ends of which on the one hand engage the spring-receiving means 7 and on the other hand engage the take-up or tensioning pulley 8. The belt 9 is guided about a guide pulley 11; one end of the belt 9 is fastened to the pulley 8, and the other end of the belt 9 is fastened to a crosspiece 12 which is connected to the hanging door 5. In this way, the hanging door 5 can be kept under tension by the pretensioned leg spring 10 during the time it is being wound up and unwound.

On that side remote from the drive unit 6, there is also disposed a take-up or tensioning pulley 8 having a belt 9 for taking up or tensioning the hanging door 5, and having a further leg spring 10. However, this pulley 8 is not mounted on the winding shaft 3, but rather the pulley 8 is mounted freely rotatably on a tensioning shaft 13 for pretensioning a coil spring for balancing out the weight of the hanging door 5. The tensioning shaft 13 is guided by a spring-receiving means 15 which is inwardly disposed in the winding tube 4, so that the leg ends of the second leg spring 10 on the one hand can engage the take-up or tensioning pulley 8 and on the other hand can engage the spring-receiving means 15. In this way, the second leg spring 10 is also operatively connected with the winding shaft 3 by means of the spring-receiving means 15, the winding tube 4, and the spring-receiving means 7.

The coil spring 14 for balancing out the weight of the hanging door 5 can be pretensioned by means of a tensioning ring 16 which is mounted on the framework 2.

The hanging door 5 and the crosspiece 12 extend into the framework 2 via guide means 17, so that a draft-free closure of the opening 1 is assured.

The present invention is, of course, in no way restricted to the specific disclosure of the specification and drawing, but also encompasses any modifications within the scope of the appended claims.

What I claim is:

1. A roll-up door means, in combination comprising:

a hanging door having a mass weight with a free end which can be rolled up as well as unwound and including a winding tube having two ends, one of said ends having a first inside-arranged spring receiving means mounted on a winding shaft for winding up and unwinding said hanging door for opening and closing-off an opening the other of said ends having a second inside-arranged spring receiving means connecting a pretensioned spring means relative to a fixed shaft for balance of the mass weight of said hanging door, said second spring receiving means being rotatably mounted on said fixed shaft being disposed between said second spring receiving means and said fixed shaft is said pretensioned spring means, a tensioning mechanism, being disposed between the free end of said hanging door and said winding tube, said winding tube also including therewith traction members which are guided about guide pulleys; said traction members being fixed with one end on said free end of said door and with the other end on said tensioning mechanism which comprises:

tensioning pulleys which are freely rotatably mounted at both ends of said winding tube; and pretensioned leg springs respectively disposed between each of said tensioning pulleys and said winding tube;

said ends of said winding tube being axially recessed at each end thereof; and said leg springs being disposed in said axial recesses of said winding tube so that no additional casing is required, said leg springs being subjected only to bending stresses particularly for long service life and no risk to safety.

2. A door means in combination according to claim 1, in which said tensioning mechanism includes belts which have a flat cross-section.

3. A door means in combination according to claim 2, in which said belts have a thickness which corresponds approximately to a thickness of said hanging door.

* * * * *